United States Patent [19]

Moore, Jr. et al.

[11] Patent Number: 4,580,696

[45] **Date of Patent: * Apr. 8, 1986**

[54] RETAINER AND DISPENSER FOR FOOD CONTAINERS IN FAST FOOD ESTABLISHMENT

[76] Inventors: Franklin Moore, Jr., 902 McBurney Dr., Lebanon, Ohio 45036; Clinton Fultz, 508 Preston Dr., Waynesville, Ohio 45068

[ * ] Notice: The portion of the term of this patent subsequent to Oct. 16, 2001 has been disclaimed.

[21] Appl. No.: 639,435

[22] Filed: Aug. 10, 1984

Related U.S. Application Data

[63] Continuation of Ser. No. 348,350, Feb. 12, 1982, Pat. No. 4,476,996.

[51] Int. Cl.[4] ..... B65H 1/00

[52] U.S. Cl. ..... 221/61; 221/63

[58] Field of Search ..... 221/1, 33, 45–46, 221/61, 63, 303, 307, 310; 211/49.1; 312/42–43

[56] References Cited

U.S. PATENT DOCUMENTS

| | | | |
|---|---|---|---|
| 1,134,651 | 4/1915 | Tramell | 221/63 |
| 1,664,164 | 3/1928 | Endter | 221/63 |
| 1,698,239 | 1/1929 | Morin | 221/63 X |
| 1,726,813 | 9/1929 | Endter | 221/63 X |
| 2,818,996 | 1/1958 | Ginther | 221/46 |
| 3,152,697 | 10/1964 | Berman et al. | 211/49 D |
| 4,094,443 | 6/1978 | Whelam | 221/63 |
| 4,266,665 | 5/1981 | Nelson | 221/63 X |
| 4,476,996 | 10/1984 | Moore, Jr. et al. | 221/63 X |

FOREIGN PATENT DOCUMENTS

| | | | |
|---|---|---|---|
| 151150 | 4/1953 | Australia | 211/49 D |

*Primary Examiner*—Charles A. Marmor

*Attorney, Agent, or Firm*—Jacox & Meckstroth

[57] ABSTRACT

A retainer and dispenser for paper-like containers or cups in which french fried potatoes or the like are served in a fast-food type of establishment. The retainer and dispenser comprises a housing adapted to be supported in substantially vertical orientation. The housing has an opening at the upper portion thereof through which the paper-like cups are loaded into the housing, as the cups are inverted and in a nested stack. The housing has an opening at the lower portion thereof. Adjacent the opening at the lower portion of the housing is an abutment member or members which are engaged by the lowermost cup in the stack thereof. The abutment member establishes the lowermost position of the lowermost cup in the stack thereof. The portion of the cup which engages the abutment member is readily bent or deflected for removal of the lowermost cup from the stack of cups and from the housing.

3 Claims, 8 Drawing Figures

RETAINER AND DISPENSER FOR FOOD CONTAINERS IN FAST FOOD ESTABLISHMENT

RELATED APPLICATION

This application is a continuation of Application Ser. No. 348,350, filed Feb. 12, 1982, now U.S. Pat. No. 4,476,996 issued, Oct. 16, 1984.

BACKGROUND OF THE INVENTION

In a fast-food establishment, french fried potatoes and the like are sold. An order of french fried potatoes is usually served to a customer in a paper-like container or cup, sometimes referred to as a scoop. In order to occupy minimum space, a supply of the containers or cups or scoops is customarily maintained in a stacked nested condition. When a customer places an order for "french fries", the attendant or waitress removes one of the cups or containers from the stack. The cup has an extending wall portion and is moved in a scooping acting during filling thereof from a supply of french fried potatoes.

If the supply or stack of cups or containers or scoops is not in a dispenser, the attendant or waitress must employ both hands to remove a cup or container from the stack. In so doing, more than one cup may, inadvertently, be removed from the stack and may have to be replaced in the stack or discarded. In the use of known retainer and/or dispenser units, difficulty is encountered in removing a cup or container from the unit. It is sometimes necessary to use two hands to remove a cup or container from a conventional holder or dispenser. It is sometimes difficult to remove a cup without also withdrawing another cup from the dispenser.

It is an object of this invention to provide a retainer and dispenser for cups or containers which are adapted to receive french fried potatoes or the like, particularly for use in a fast-food establishment, and from which the cups or containers are easily and readily individually dispensed.

It is another object of this invention to provide such a retainer and dispenser into which a stack of cups is easily and readily loaded.

It is another object of this invention to provide such a retainer and dispenser which can be easily and readily attached to a wall or other support member.

Other objects and advantages of this invention reside in the construction of parts, the combination thereof, the method of production and the mode of use, as will become more apparent from the following description.

BRIEF SUMMARY OF THE INVENTION

This invention comprises a retainer and dispenser for cups or containers or scoops which are adapted to contain french fried potatoes or other foods, or the like. The holder and dispenser comprises a housing or frame member which is adapted to be attached to a wall or other support member. The housing or frame has an opening in the upper portion thereof to receive a stack of nested cups or containers. The stack of cups is retained in the retainer and dispenser with the cups in an inverted position. The holder and dispenser has one or more members forming a guide for movement of the cups downwardly from the opening in the upper portion thereof. The housing or frame has an opening in the lower portion thereof through which the cups move from the housing or frame. In order that a cup can also serve as a scoop in the filling of the cup, each cup has a portion which extends from the opening therein. At the lower portion of the housing or frame is one or more abutment members, engageable by the extending wall portion of the lowermost cup in the nested stack thereof.

In order to remove the lowermost cup from the nested stacked thereof, the extending wall portion of the lowermost cup is manually grasped and deflected from the abutment member. When the lowermost cup is thus grasped and removed, the cup which is next immediately above the lowermost cup falls downwardly. The extending wall thereof engages the abutment member and prevents the cup from moving from the opening in the lower portion of the frame or housing. The other cups in the nested stack thereof move downwardly as the lowermost cup is removed from the stack.

DETAILED DESCRIPTION OF THE INVENTION

Figure 1:
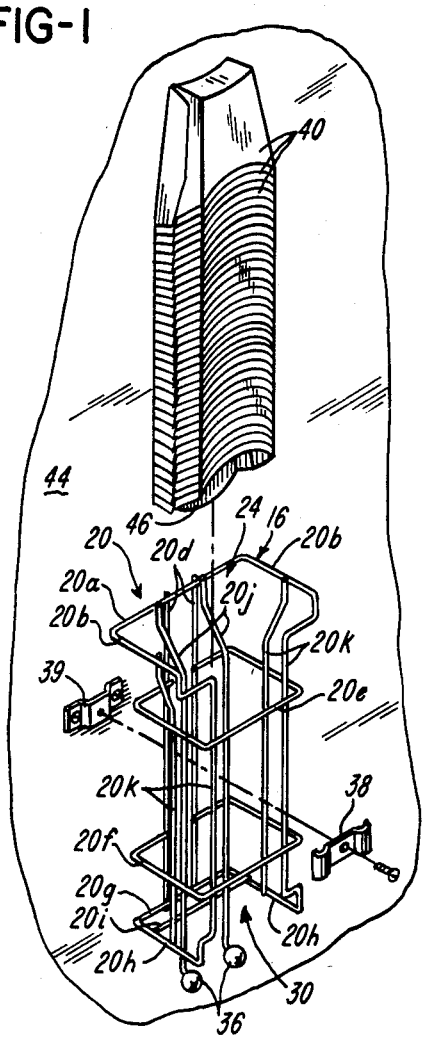
FIG. 1 is an exploded perspective view showing the cup retainer and dispenser of this invention and illustrating movement of a nested stack of cups into the retainer and dispenser.

A retainer and dispenser of this invention comprises a housing 16. The housing 16 may be constructed of any suitable elements or materials. Herein the housing 16 is shown as being elongate and adapted to be oriented substantially vertically. The housing 16 is shown as comprising a plurality of rigid wire members or rod members 20 which are attached together and arranged and shaped to provide an opening 24 at the upper portion thereof and an opening 30 at the lower portion thereof. The opening 24 at the upper portion of the housing 16 is larger than the opening 30 at the lower portion thereof.

The wire members 20 include an upper substantially horizontal back portion **20*a* joined to horizontal opposed side portions 20b. Extending downwardly from the upper horizontal back portion 20a is a pair of vertical wire members 20d. Attached to the vertical wire members 20d and spaced below the horizontal back portion 20a and the side portions 20b is a horizontal intermediate wire member 20e** which is shown as being substantially rectangular in shape.

Below the horizontal intermediate wire member 20e and attached to the vertical wire members 20d is a lower horizontal wire member 20f which is shown as being substantially rectangular in shape.

Below the lower horizontal wire member 20f and attached to the vertical wire members 20d is a horizontal back base portion 20g, from which extends opposed horizontal base side portions 20h. Attached to the horizontal base side portions 20h and spaced forwardly from the horizontal back base portion 20g and substantially parallel thereto is a horizontal connector wire member 20a.

Extending downwardly from the upper back portion 20a is a pair of elongate wire members 20j which slope forwardly from the back portion 20a and then extend vertically downwardly therefrom. The wire members 20j are spaced from the horizontal intermediate wire member 20e and are spaced from the lower horizontal wire member 20f. The wire members 20j are attached to the connector wire member 20e and extend downwardly therefrom. At the lower end of each of the wire members 20j is an abutment member 36, herein shown as being substantially spherical in shape.

Attached to the horizontal side portions 20b and extending angularly downwardly therefrom are side wire members 20k. The wire members 20k are attached to the horizontal intermediate wire member 20e and extend vertically downwardly therefrom and are attached to the lower horizontal wire member 20f. The wire members 20k extend from the lower horizontal wire member 20f to the horizontal base side portions 20h.

If desired, the wire members 20e and 20f may not be rectangular in shape and may be open between the front wire members 20k.

As illustrated in FIG. 1, bracket elements 38 and 39 are employed to attach the housing 16 to a wall 44 or other support member, as the bracket elements encompass the vertical wire members 20d.

As illustrated in FIG. 1, a nested stack of cups or containers 40 is readily inserted into the housing 16 through the opening 24 in the upper portion of the housing 16. As illustrated, the nested stack of cups or containers 40 is inserted into the housing 16 with the opening in each cup 40 in a downward orientation. Thus, the cups 40 are inverted as they are positioned within the housing 16. The opening 24 in the upper portion of the housing 16 is sufficiently large to permit a stack of cups to be readily inserted into the housing 16. A space is provided between the side portions 20b so that a person's hand may be inserted between the side portions 20b to assist in guiding downward movement of the nested stack of cups 40 into the housing 16. The vertical wire members 20j and 20k assist in guiding downward movement of the cups 40 from the opening 24.

In order that a cup may be filled with a scooping action, each cup 40 has an extending back wall 46. The extending back wall 46 of the lowermost cup 40 engages the abutment members 36. Thus, the position of the nested stack of cups 40 is established within the housing 16, as illustrated in FIGS. 2 and 5.

Figure 2:
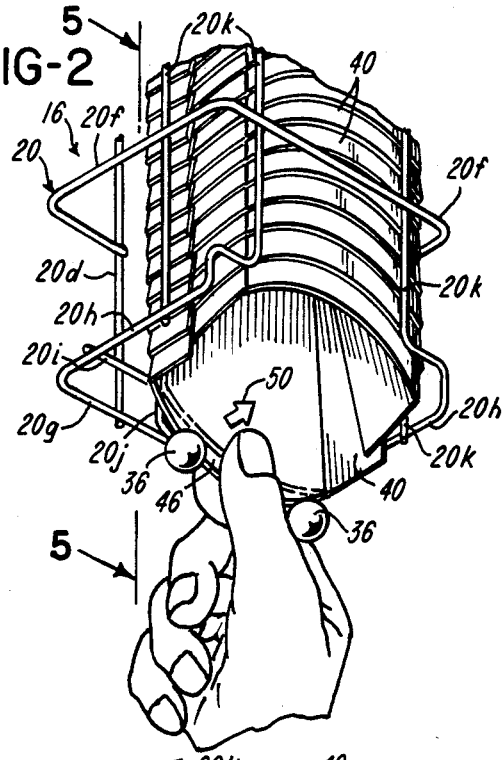
FIG. 2 is a fragmentary perspective view, drawn on a larger scale than FIG. 1, showing a nested stack of cups within the retainer and dispenser and illustrating an initial step in removing a cup from the retainer and dispenser.
Figure 2:
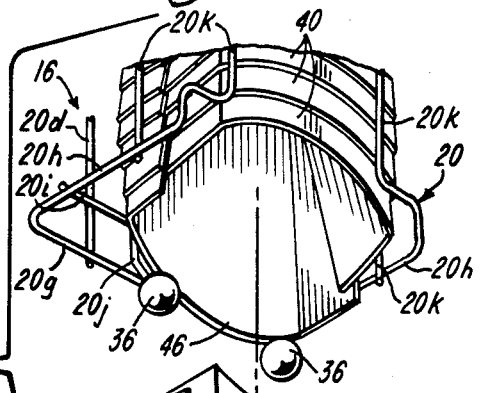
Figure 3:
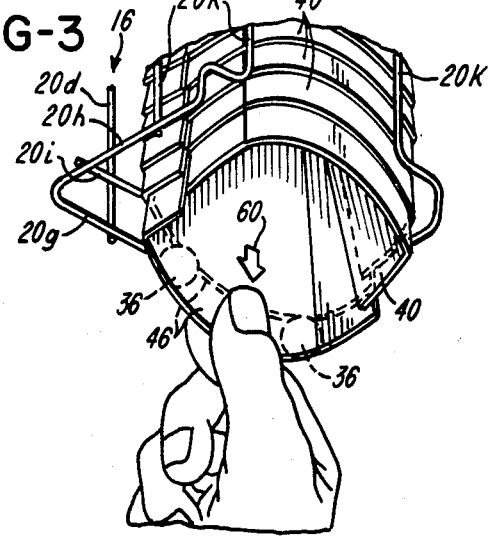
FIG. 3 is a fragmentary perspective view, similar to FIG. 2, illustrating a succeeding step in removal of a cup from the retainer and dispenser.
Figure 4:
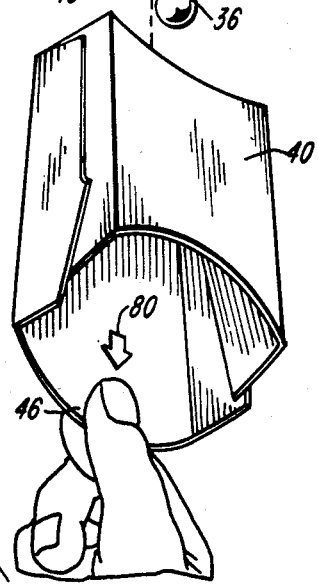
FIG. 4 is a fragmentary perspective view similar to FIGS. 2 and 3, illustrating a further step in removal of a cup from the retainer and dispenser and illustrating the position assumed by a succeeding cup as the preceding cup moves from the retainer and dispenser.
Figure 5:
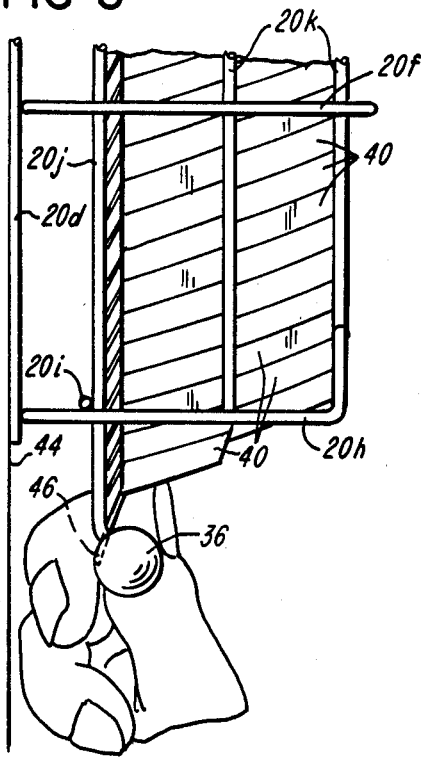
FIG. 5 is a fragmentary elevational view taken substantially on line 5—5 of FIG. 2, drawn on a larger scale than the preceding figures. This figure shows the nested cups prior to the first step in removal of the lowermost cup from the stack thereof.
Figure 6:
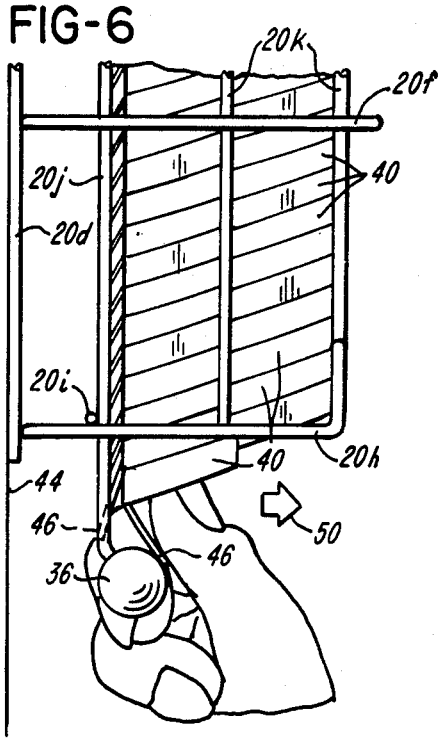
FIG. 6 is a fragmentary elevational view similar to FIG. 5, but illustrating an initial step in removal of the lowermost cup from the stack thereof.
Figure 7:
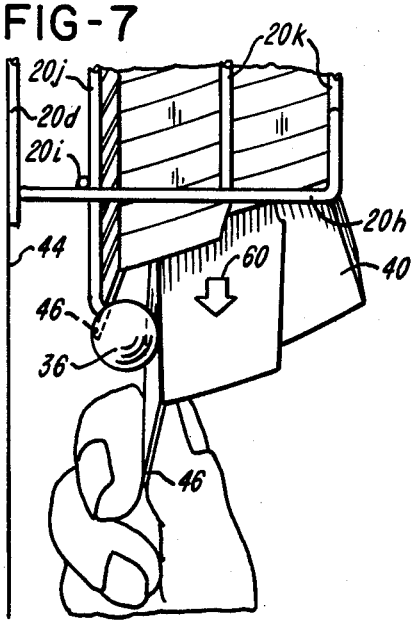
FIG. 7 is a fragmentary elevational view similar to FIG. 5 and 6 and illustrating a succeeding step in removal of the lowermost cup from the nested stack thereof.
Figure 8:
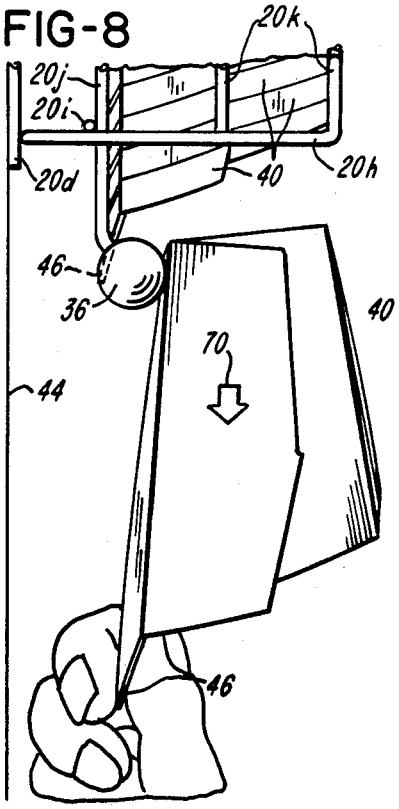
FIG. 8 is a fragmentary elevational view similar to FIGS. 5–7, and illustrating a further step in removing a cup from the nested stack thereof.

When it is desired to remove a cup 40 from the nested stack thereof as the cups 40 are retained by the housing 16, the extending back wall 46 of the lowermost cup 40 is grasped by a person's fingers, as illustrated in FIGS. 2 and 5. Due to the fact that there is no element between the base side portions 20h at the front part of the housing 16, and due to the fact that the lower ends of the wire members 20j are spaced forwardly from the back base portion 20g, a person's fingers can easily and readily reach the extending back wall portion 46 of the lowermost cup as the back wall portion 46 rests upon the abutment members 36. Then the extending back wall portion 46 of the lowermost cup 40 is bent or deflected slightly forwardly, as illustrated by an arrow 50 in FIGS. 2 and 6. Then the lowermost cup 40 is pulled downwardly from the stack of cups 40 and from the abutment members 36, as illustrated progressively by arrows 60, 70, and 80 in FIGS. 3, 4, 7, and 8. As the lowermost cup 40 is removed from engagement with the abutment members 36 and moved downwardly therefrom the next succeeding cup 40 moves downwardly, and the extending back wall portion 46 thereof engages the abutment members 36, as illustrated in FIGS. 3, 4, 7, and 8.

Thus, the cups 40 in the nested stack thereof are easily and readily consecutively removed from the housing 16. Each cup 40 is readily removed, without the inadvertent simultaneous removal of more than one cup 40.

After all of the cups 40 in the housing 16 are removed by this process, or at any time prior to removal of all of the cups 40 in the stack, additional cups 40 can be readily loaded into the housing 16, either individually or in a stack, as illustrated in FIG. 1.

Although the preferred embodiment of the retainer and dispenser of this invention has been described, it will be understood that within the purview of this invention various changes may be made in the form, details, proportion and arrangement of parts, the combination thereof, and the mode of use, which generally stated consist in a structure within the scope of the appended claims.

The invention having thus been described, the following is claimed:

1. A dispenser for folded paperboard cups each including a back panel having a projecting lip portion extending beyond a front panel to contain a product adapted to be sold in a fast-food establishment, said dispenser comprising a series of spaced vertical wires rigidly connected by a series of horizontal cross wires to form an open top wire housing for receiving a stack of the cups arranged in inverted nested relation, the wires forming a rear surface of the housing for mounting of the housing on a wall, at least one vertical stack guide wire spaced forwardly from the rear surface of the housing to define a finger space between the back panels of the stack of nested cups and the rear surface of the housing, an enlarged abutment member secured to the lower end portion of each vertical stack guide wire, each abutment member being positioned to form a stop for the projecting lip portion of the back panel of the lowermost inverted cup in the stack to retain the stack of cups within the wire housing, and each abutment member having a front guide surface providing for the removal of the lowermost inverted cup from the stack in response to manual flexing of the lip portion forwardly around the guide surface.

2. The retainer and dispenser of claim 1 in which the front guide surface of each abutment member is curved.

3. The retainer and dispenser of claim 1 in which the front guide surface of each abutment member is at least a portion of a generally spherical member.

* * * * *

UNITED STATES PATENT AND TRADEMARK OFFICE

CERTIFICATE OF CORRECTION

PATENT NO. : 4,580,696
DATED : April 8, 1986
INVENTOR(S) : Franklin Moore, Jr. and Clinton Fultz It is certified that error appears in the above-identified patent and that said Letters Patent are hereby corrected as shown below:

Column 1, line 20, change "acting" to---action---.

Column 3, line 18, change "20a" to---20i---.

Column 3, line 26, change "20e" to---20i---.

Signed and Sealed this

*Twenty-ninth* Day of *July 1986*

[SEAL]

*Attest:*

DONALD J. QUIGG

*Attesting Officer*

*Commissioner of Patents and Trademarks*